United States Patent [19]

Pennington

[11] 4,278,024

[45] Jul. 14, 1981

[54] QUALITY CONTROL STAMPING HAMMER

[75] Inventor: Chester R. Pennington, Conyers, Ga.

[73] Assignee: Timber Products Inspection & Testing Service, Conyers, Ga.

[21] Appl. No.: 89,303

[22] Filed: Oct. 30, 1979

[51] Int. Cl.[3] ..... B41K 1/56

[52] U.S. Cl. ..... 101/405

[58] Field of Search ..... 101/405, 406; D18/14–18

[56] References Cited

U.S. PATENT DOCUMENTS

| | | | |
|---|---|---|---|
| 894,013 | 7/1908 | Kiam | 101/405 X |
| 1,034,516 | 8/1912 | Samberg | 101/405 |
| 1,038,219 | 9/1912 | Smith | 101/405 |
| 1,064,207 | 6/1913 | Graham et al. | 101/405 X |
| 1,078,601 | 11/1913 | Matthews | 101/405 X |
| 1,108,314 | 8/1914 | Anderson | 101/405 |
| 1,789,833 | 1/1931 | Pannier, Jr. et al. | 101/406 |
| 2,028,711 | 1/1936 | Swan et al. | 101/379 X |
| 2,857,839 | 10/1958 | Jamieson | 101/405 |
| 2,994,266 | 8/1961 | Sparrow | 101/405 X |
| 3,620,159 | 11/1971 | Gould | 101/28 |

FOREIGN PATENT DOCUMENTS

| | | | |
|---|---|---|---|
| 520163 | 3/1931 | Fed. Rep. of Germany | 101/405 |
| 1053531 | 3/1959 | Fed. Rep. of Germany | 101/405 |
| 28161 | of 1915 | United Kingdom | 101/406 |

*Primary Examiner*—E. H. Eickholt

*Attorney, Agent, or Firm*—Roylance, Abrams, Berdo & Farley

[57] ABSTRACT

A stamping hammer for printing quality control indicia on a flat article comprising a rigid, flat base plate, an elongated handle rigidly coupled to the base plate at a fixed angle of about 5°–15°, a resilient, shock-absorbing layer rigidly coupled to the base plate, and a rubber stamp pad rigidly coupled to the shock-absorbing layer. The stamp pad has raised characters thereon corresponding to the indicia to be printed onto the flat article.

12 Claims, 7 Drawing Figures

QUALITY CONTROL STAMPING HAMMER

FIELD OF THE INVENTION

The present invention relates to a stamping hammer for printing quality control indicia on a flat article, such as lumber treated by a preservative. The stamp pad used on the hammer is formed of rubber and has raised characters thereon corresponding to the indicia to be stamped on the article. Ink is applied to the stamp pad characters, which is transferred, and therefore printed, onto the article when the stamp pad contacts the article by swinging the hammer.

BACKGROUND OF THE INVENTION

After felled timber in the form of logs has been passed through a lumber mill and cut into usable pieces of lumber, many of these pieces of lumber are treated with a preservative in the mill. This is commonly accomplished by running the cut lumber through a vat of liquid preservative and then removing the treated pieces of lumber on an endless conveyor. At that time, a quality control stamping or printing of various indicia is performed on the lumber so that users of the cut and treated lumber will have descriptive information readily available on the lumber itself. In particular, this information commonly includes the specifications and certification trademark of the American Wood Preservation Bureau; the name of the treatment company and its trademark; the amount of treatment given to the lumber; the name or number of the mill manufacturing the cut lumber; and the trademark and name of Timber Products Inspection & Testing Service, Inc.. The stamping is usually done on one end of a piece of lumber about 18 inches to two feet from the end, or in certain pieces of lumber about 18 inches to two feet from both ends.

Presently, the larger mills utilize highly automated, expensive and large stamping machines. However, many mills still utilize an old hand-held stamping device comprised of a curved rigid plate, having a handle on one side and a rubber stamp pad on the other. This prior art device is extremely slow to use since the imprint from the stamp pad must be rolled onto the lumber from the curved support plate. In addition, such a device is hard on the hands of the operator and often results in an inaccurate or incomplete stamping since a minimum amount of pressure must be applied from the stamp pad to the cut lumber. Moreover, in those situations where long pieces of lumber must have two stamps, one at each end, two people must perform the stamping operation since the hand-held device is not large enough to conveniently stamp both ends.

Although there have been in the prior art various marking or stamping hammers, these do not disclose or utilize a rubber stamp pad which is required for such a quality control stamping of cut pieces of lumber. Such prior art devices are disclosed in the following U.S. Pat. Nos. 1,034,516, issued to Samberg on Aug. 6, 1912; 1,084,207, issued to Graham et al on June 10, 1913; 1,078,601, issued to Matthews on Nov. 11, 1913; 2,857,839, issued to Jamieson on Oct. 28, 1958; and 3,620,159, issued to Gould on Nov. 16, 1971. In addition, there is a design patent U.S. Pat. No. Des. 248,417, issued to Pennington, the inventor herein, on July 4, 1978; however, the rubber stamp hammer head disclosed therein is too flexible to provide the quality control stamping outlined above.

OBJECTS OF THE INVENTION

Accordingly, it is a primary object of the present invention to provide a quality control stamping hammer capable of placing printed indicia on cut lumber accurately and without undue exertion.

Another object of the present invention is to provide such a stamping hammer which can easily provide a plurality of stamps on one piece of cut lumber at spaced locations.

Another object of the present invention is to provide such a stamping hammer which is easy on the hand and arm of the operator.

The foregoing objects are basically attained by providing a quality control stamping hammer for printing indicia on a flat article comprising a rigid, metallic base plate having top and bottom planar surfaces; an elongated handle; means for rigidly coupling the handle to the base plate wherein the longitudinal axis of the handle is at a fixed angle to the base plate top plane surface of greater than 0° and less than about 45°; a rubber stamp pad having a top planar surface and a bottom surface, the bottom surface having raised characters thereon corresponding to the indicia to be printed onto the flat article; a resilient, shock-absorbing layer having top and bottom planar surfaces; means for rigidly coupling the top surface of the shock-absorbing layer to the bottom surface of the base plate; and means for rigidly coupling the top planar surface of the stamp pad to the bottom surface of the shock-absorbing layer.

By so providing such a stamping hammer, the required markings or indicia can easily be provided on a cut piece of lumber without undue exertion by a mere striking of the hammer with the rubber stamp pad at the end. Since the handle is elongated two prints can be made on a long piece of lumber, thereby eliminating the requirement of an extra operator where two stamps must be made.

Since there is a shock-absorbing layer between the metallic base plate and the rubber stamp pad, any significant misalignment of the stamp pad relative to the planar surface of the cut lumber is absorbed so that an accurate stamping will take place, thereby eliminating stamps of poor quality which require restamping.

Other objects, advantages and salient features of the present invention will become apparent from the following detailed description, which, taken in conjunction with the annexed drawings, discloses preferred embodiments of the present invention.

DRAWINGS

DETAILED DESCRIPTION OF THE FIGS. 1-4 EMBODIMENT

Figure 1:
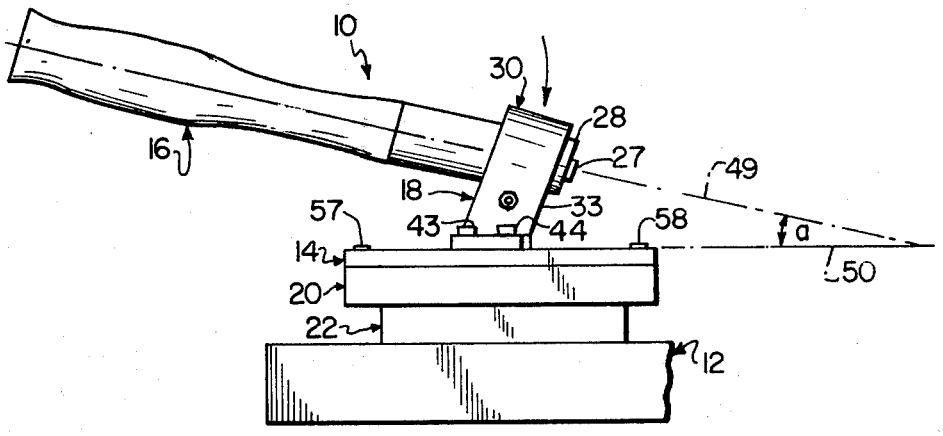
FIG. 1 is a side elevational view of the quality control stamping hammer in accordance with the present invention shown in a stamping orientation relative to a flat article such as a piece of cut lumber.

Referring now to FIGS. 1-4, a first embodiment of the quality control stamping hammer 10 in accordance with the present invention is illustrated in a position striking, and therefore printing on, a flat article 12 such as a cut piece of lumber.

As seen in FIGS. 1-4, the hammer 10 is comprised of a base plate 14, an elongated handle 16, a coupling mechanism 18 for rigidly coupling the handle to the base plate, a shock-absorbing pad 20 coupled to the base plate, and a stamp pad 22 coupled to the shock-absorbing pad.

Figure 3:
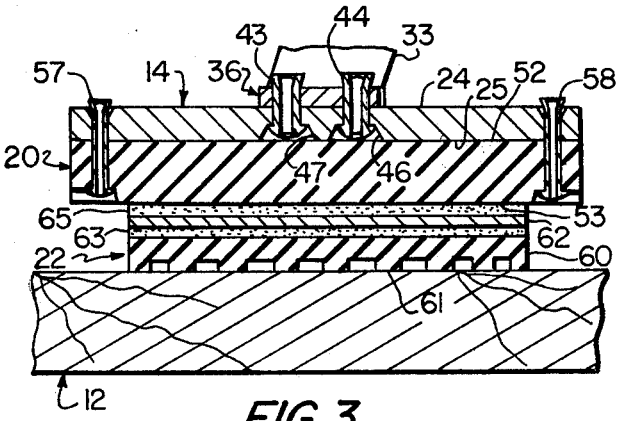
FIG. 3 is a fragmentary side elevational view in section taken along lines 3—3 in FIG. 2.

As seen in FIG. 3, the base plate 14 is a rigid, metallic plate having a top planar surface 24 and a bottom planar surface 25, the plate being rectangular in plan view and having a rectangular cross-section.

Figure 2:
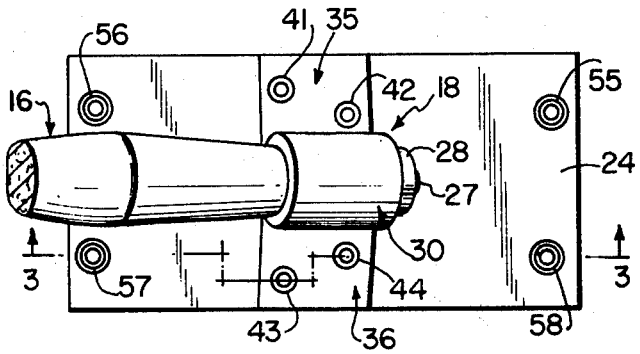
FIG. 2 is an enlarged fragmentary top plan view of the hammer shown in FIG. 1.
Figure 4:
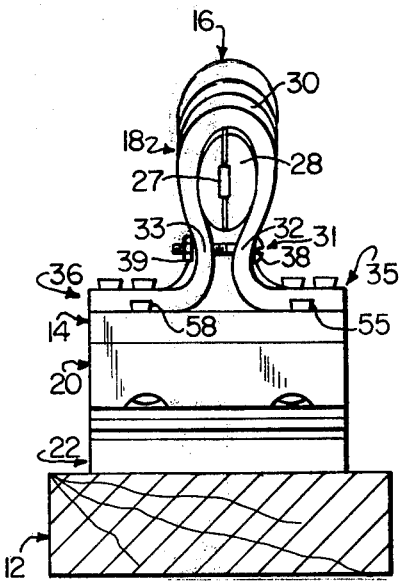
FIG. 4 is an enlarged front elevational view of the hammer shown in FIG. 1.

The handle 16 is preferably a conventional wooden hammer handle with a wedge 27, as seen in FIGS. 1, 2 and 4, driven into the end 28 adjacent the coupling mechanism 18 to help secure the handle thereto. Removal of the wedge 27 provides for easy replacement of the handle upon deterioration of the handle itself or when a larger or smaller one is desired. The handle end 28 received in the coupling mechanism 18 is preferably tapered to provide a tight fit thereto in conjunction with the wedge 27.

The coupling mechanism 18 as seen in FIGS. 1, 2 and 4, comprises an integral bent, metallic support formed of a eye portion 30, a central portion 31 extending therefrom and formed from two side-by-side elements 32 and 33, and two legs 35 and 36 extending respectively from elements 32 and 33. Legs 35 and 36 are bent so that they are substantially parallel to the top planar surface 24 of the base plate 14 and extend to the outer edges of that base plate 14 as seen in FIGS. 2 and 4. The eye portion 30 is midway between the side edges of plate 14. As seen in FIG. 4, the handle and 28 is received in the eye portion 30, there being a fastener in the form of a bolt 38 and nut 39 interconnecting the elements 32 and 33 below the handle end 28 by passing through suitable, aligned bores in elements 32 and 33.

As seen in FIGS. 1-4, a plurality of fasteners in the form of four pop-rivets 41, 42, 43 and 44 rigidly couple the coupling mechanism 18 to the base plate 14 midway between the ends of the plate. This is accomplished by providing suitable aligned bores in legs 35 and 36 of the coupling mechanism 18 and the base plate 14 for the reception of the rivets 41-44 shown in FIGS. 1-4. Advantageously, the bottoms of the rivets, as seen in FIG. 3 for rivets 43 and 44, do not extend below the bottom surface 25 of the base plate 14 so that this surface does not present any outward protrusions against the shock-absorbing layer 20 therebelow. This is accomplished by providing recesses or countersinks in the bottom of the base plate 14 as seen in FIG. 3, the two countersinks shown therein being numbered 46 and 47.

As seen in FIGS. 1-4, the coupling mechanism 18 is so formed that the elements 32 and 33 coupled to the eye portion 30 are at an acute angle, provided by suitable twisting of the coupling mechanism 18, so that the longitudinal axis of the handle 16 having reference numberal 49 in FIG. 1 is at a small acute angle "a" relative to the plane containing the top planar surface 24 of base plate 14, such plane having reference numeral 50. Preferably, this angle "a" is greater than 0° and less than about 45°, and more preferably it is in the range of between about 5° and 15°. By so providing such an angle, an accurate stamping can be performed without danger of the operator's hand striking the article or other obstruction below the handle. The angle is a small one since a large angle would decrease the accuracy with which the hammer can be manipulated.

The shock-absorbing pad or layer 20 has a top planar surface 52 and a bottom planar surface 53 and is about twice as thick as plate 14 and pad 22. The shock-absorbing pad is rigidly coupled to base plate 14 with its top surface lying against and contacting the bottom surface 25 of the base plate 14. This rigid coupling is accomplished by means of four fasteners in the form of pop-rivets 55, 56, 57 and 58 which pass through four bores formed completely through the shock-absorbing pad 20 and four aligned bores in the base plate 14. These four rivets 55-58 are positioned so that two are at one end of the base plate 14 and the other two are at the other end.

The stamp pad 22 is rigidly coupled to the bottom surface 53 of the shock-absorbing pad 20 as seen in FIG. 3. Since the rivets 55-58 tend to upwardly distort the bottom surface 53 of the shock-absorbing pad 20, the longitudinal length of the stamp pad 22 is less than the distance between the rivets at opposite ends of the plate 14 so that the stamp pad will not be exposed to an irregular surface during the striking operation.

The stamp pad 22 comprises a resilient portion 60 formed of rubber having raised characters 61 formed therein, a somewhat rigid backing portion 62 and a layer of adhesive 63 interposed between backing portions 62 and resilient portion 60. The stamp pad 22 is rigidly coupled to the bottom surface 53 of the shock-absorbing pad 20 by means of a second layer of adhesive 65, seen in FIGS. 3 and 4, interposed between backing portion 62 and surface 53.

In order to utilize the stamping hammer in accordance with the present invention, the operator merely grips the end of handle 16 and downwardly strikes the article 12 with the stamp pad 22, after a suitable ink has been applied to the characters 61 on the bottom surface thereof. These characters 61 correspond to the indicia to be printed on the article 12 and after the striking takes place these characters leave their imprint on the article providing the required indicia.

Because of the elongated handle which is firmly and rigidly coupled to the base plate 14, a very positive stamping can be accomplished even at a great distance from the position at which the operator is standing and without undue exertion or stress on the operator's hand and arm.

Because of the fixed angle "a" between the longitudinal axis of the handle and the top planar surface of the base plate 14, potential injury to the operator is avoided.

Moreover, because of the shock-absorbing pad 20, potential printing inaccuracy is avoided since this pad compensates for misaligned or misoriented stamps.

EMBODIMENT OF FIGS. 5 AND 6

Figure 5:
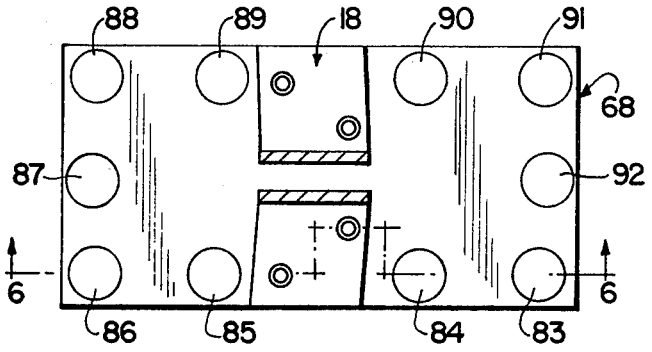
FIG. 5 is a fragmentary top plan view of a second embodiment of the present invention in which the shock-absorbing layer is coupled to the base plate by integral projections received in bores and countersinks in the base plate.
Figure 6:
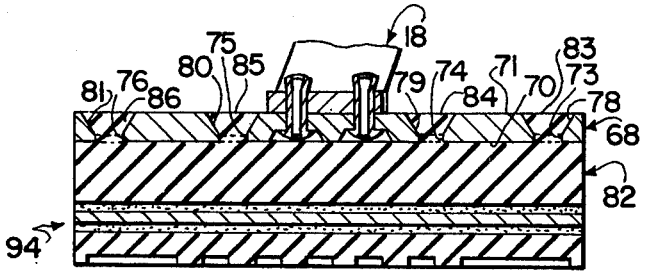
FIG. 6 is a fragmentary side elevational view in section taken along lines 6—6 in FIG. 5 showing the second embodiment.

A second embodiment of the present invention is shown in FIGS. 5 and 6 in which the shock-absorbing pad is rigidly coupled to the base plate, not by a plurality of rivets, but by integral projections extending upwardly from the rubber shock-absorbing pad into bores in the base plate. This is accomplished by curing the rubber to form the shock-absorbing pad in a press incorporating the bored base plate therein.

As seen in FIGS. 5 and 6, the base plate 68 is a rigid, metallic plate having a rectangular form in plan view and is coupled rigidly to the coupling mechanism 18 for the handle 16 in a manner similar to that shown in FIG. 1. This includes a plurality of rivets which are recessed upwardly from the bottom surface 70 of base plate 68, the coupling mechanism 18 lying on top planar surface 71 of base plate 68.

The base plate 68 has a plurality of bores formed therein along the outer periphery thereof. These bores are right cylindrical, there being 10 such bores formed in base plate 68, four of which are clearly shown in FIG. 6 and numbered 73, 74, 75 and 76. Each of the 10 bores has a countersink directly communicating therewith formed downwardly from the top surface 71 of base plate 68, countersinks 78, 79, 80 and 81 being shown in FIG. 6 corresponding respectively with bores 73–76.

In order to rigidly couple the shock-absorbing pad 82 to the base plate 68 a plurality of projections are integrally formed with the pad and extend from the pad top surface into the bores and countersinks therein, these projections having an outer configuration corresponding to the configuration of the bores and countersinks in the base plate 68. There is one projection for each of the combined bore and countersink, these 10 projections being numbered 83–92, as seen in FIGS. 5 and 6.

The stamp pad 94 seen in FIG. 6 is substantially the same as that disclosed in FIGS. 1–4 and has a similar construction and rigid coupling to the shock-absorbing pad as that described above regarding FIGS. 1–4. However, in this second embodiment, the length of the stamp pad 94 is substantially the same as the length of the shock-absorbing pad 82, since there are no rivets passing through the shock-absorbing pad to be avoided.

EMBODIMENT OF FIG. 7

Figure 7:
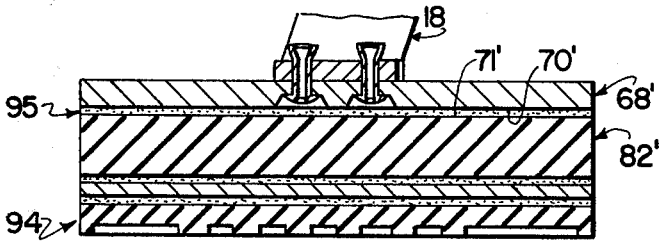
FIG. 7 is a fragmentary side elevational sectional view similar to that shown in FIG. 6 except illustrating a third embodiment of the present invention in which the shock-absorbing layer is coupled to the base plate by means of an adhesive layer.

A third embodiment of the present invention is shown in FIG. 7 in which the shock-absorbing pad 82' is rigidly coupled to the bottom surface 70' of the base plate 68' by means of an adhesive layer 95 interposed between that bottom surface 70' and the top surface 71' of the shock-absorbing pad 82'.

The bores and countersinks are eliminated from the base plate, and in all other respects the apparatus shown in FIG. 7 is similar to that shown in FIG. 6.

While various advantageous embodiments have been chosen to illustrate the invention, it will be understood by those skilled in the art that various changes and modifications can be made therein without departing from the scope of the invention as defined in the appended claims.

What is claimed is:

1. A quality control stamping hammer for printing indicia on a flat article comprising:

a rigid, metallic base plate having top and bottom planar surfaces;

an elongated handle;

means for rigidly coupling said handle to said base plate wherein the longitudinal axis of said handle is at a fixed angle to said base plate top planar surface of greater than 0° and less than about 45°;

a rubber stamp pad having a top planar surface and a bottom surface, said bottom surface having raised characters thereon corresponding to the indicia to be printed onto the flat article;

a resilient, shock-absorbing layer having top and bottom planar surfaces;

means for rigidly coupling said top surface of said shock-absorbing layer to said bottom surface of said base plate; and means for rigidly coupling said top planar surface of said stamp pad to said bottom surface of said shock-absorbing layer;

said means for rigidly coupling said handle to said base plate including a metallic support, said metallic support including a rigid eye portion rigidly receiving an end of said handle, a rigid central portion extending from said eye portion, and means for rigidly coupling said central portion to said base plate top surface.

2. A hammer according to claim 1, wherein said means for rigidly coupling said central portion to said base plate top surface includes a plurality of fasteners extending through said support and said base plate, said fasteners being recessed above said bottom planar surface of said base plate.

3. A hammer according to claim 1, wherein said means for rigidly coupling said top planar surface of said stamp pad to said bottom surface of said shock-absorbing layer includes a layer of adhesive interposed between said top surface of said stamp pad and said bottom surface of said shock-absorbing layer.

4. A hammer according to claim 1, wherein said stamp pad includes a resilient portion having said raised characters formed therein, a backing portion, and a layer of adhesive coupling said resilient portion and said backing portion.

5. A hammer according to claim 1, wherein said resilient, shock-absorbing layer is a rubber pad.

6. A hammer according to claim 1, wherein said fixed angle is in the range of between about 5° and about 15°.

7. A hammer according to claim 1, wherein said means for rigidly coupling said top surface of said shock-absorbing layer to said bottom surface of said base plate comprises a plurality of fasteners passing through said shock-absorbing layer and said base plate, said fasteners being located at opposite ends of said shock-absorbing layer and said base plate, said stamp pad having a length less than the distance between said fasteners at said opposite ends.

8. A hammer according to claim 1, wherein said means for rigidly coupling said top surface of said shock-absorbing layer to said bottom surface of said base plate comprises an adhesive layer interposed therebetween.

9. A quality control stamping hammer for printing indicia on a flat article comprising:

a rigid, metallic base plate having top and bottom planar surfaces;

an elongated handle;

means for rigidly coupling said handle to said base plate wherein the longitudinal axis of said handle is at a fixed angle to said base plate top planar surface of greater than 0° and less than about 45°;

a rubber stamp pad having a top planar surface and a bottom surface, said bottom surface having raised characters thereon corresponding to the indicia to be printed onto the flat article;

a resilient, shock-absorbing layer having top and bottom planar surfaces;

means for rigidly coupling said top surface of said shock-absorbing layer to said bottom surface of said base plate; and means for rigidly coupling said top planar surface of said stamp pad to said bottom surface of said shock-absorbing layer;

said means for rigidly coupling said top surface of said shock-absorbing layer to said bottom surface of said base plate comprising a plurality of bores formed in said base plate along the outer periphery of said base plate, each of said bores having a countersink communicating therewith formed in said top surface of said base plate, and a plurality of projections integrally formed with said shock-absorbing layer and extending from said shock-absorbing layer top surface into said bores and countersinks, the outer configuration of said projections corresponding to the configuration of said bores and countersinks.

10. A quality control stamping hammer for printing indicia on a flat article comprising:

a rigid, metallic base plate having top and bottom planar surfaces;

an elongated handle;

means for rigidly coupling said handle to said base plate wherein the longitudinal axis of said handle is at a fixed angle to said base plate top planar surface of greater than 0° and less than about 45°;

a rubber stamp pad having a top planar surface and a bottom surface, said bottom surface having raised characters thereon corresponding to the indicia to be printed onto the flat article;

a resilient, shock-absorbing layer having top and bottom planar surfaces;

means for rigidly coupling said top surface of said shock-absorbing layer to said bottom surface of said base plate; and means for rigidly coupling said top planar surface of said stamp pad to said bottom surface of said shock-absorbing layer;

said means for rigidly coupling said handle to said base plate including a bent metallic support, said bent support including an eye portion receiving an end of said handle, a central portion extending from said eye portion, and a pair of legs extending from said central portion and coupled to said base plate top surface.

11. A hammer according to claim 10, wherein said means for rigidly coupling said handle to said base plate further includes a plurality of fasteners for coupling said pair of legs to said base plate.

12. A hammer according to claim 10, wherein said central portion includes two spaced side-by-side elements, said elements having a fastener interconnecting them.

* * * * *